US005501423A

United States Patent [19]

Roberts

[11] Patent Number: 5,501,423

[45] Date of Patent: Mar. 26, 1996

[54] PORTABLE EASEL WITH TABLE

[76] Inventor: William L. Roberts, 794 Mockingbird La., San Bernardino, Calif. 92404-2435

[21] Appl. No.: 319,314

[22] Filed: Oct. 6, 1994

[51] Int. Cl.[6] ..... A47B 97/04

[52] U.S. Cl. ..... 248/441.1; 248/460; 248/463; 248/465

[58] Field of Search ..... 248/441.1, 449, 248/452, 450, 451, 460, 463, 464, 465; 108/151, 144, 153, 157, 159

[56] References Cited

U.S. PATENT DOCUMENTS

| | | | |
|---|---|---|---|
| 392,565 | 11/1888 | Larew | 248/464 |
| 486,549 | 11/1892 | Terslose . | |
| 518,544 | 4/1894 | Faint . | |
| 1,680,056 | 8/1928 | Mathias . | |
| 1,757,032 | 5/1930 | Wilson . | |
| 2,142,317 | 1/1939 | Jarrett . | |
| 2,723,817 | 11/1955 | Harwood et al. | 248/464 |
| 2,941,774 | 6/1960 | McTear . | |
| 2,981,030 | 4/1961 | Knop . | |
| 3,015,906 | 1/1962 | Guth . | |
| 3,190,603 | 6/1965 | Finnemann . | |
| 3,195,849 | 7/1965 | Maddox . | |
| 3,692,273 | 9/1972 | Woolman . | |
| 3,765,343 | 10/1973 | Ettlinger, Jr. et al. | 108/151 X |
| 3,980,267 | 9/1976 | Palmer | 248/463 |
| 4,036,465 | 7/1977 | Kellner | 248/463 |
| 4,714,224 | 12/1987 | Calmes | 248/465 |
| 4,824,064 | 4/1989 | Oncale | 248/441.1 |
| 5,088,678 | 2/1992 | Bitan . | |
| 5,209,492 | 5/1993 | Hamilton | 248/463 X |

FOREIGN PATENT DOCUMENTS

| | | | |
|---|---|---|---|
| 1330409 | 1/1963 | France | 248/465 |
| 93/24039 | 12/1993 | WIPO | 248/441.1 |

*Primary Examiner*—Alvin C. Chin-Shue
*Assistant Examiner*—Derek J. Berger

[57] ABSTRACT

A portable easel with tray and table composed of two legs, joined at the top by a crosspiece having in it pegs for hanging a thin, rigid easel board to serve as backing for commercially available easel pads. The legs pass through holes at their approximate midpoint in a tray table which senses as a tray for marking instruments in the front, a table for papers, books and the like in the rear, and which holds the legs in their splayed position. The tray table rests on fittings which support the upper structures, join the legs laterally for rigidity at their midpoint, and into which the lower portion of the legs may be fitted and removed. The lower ends of the legs have rubber tips to increase friction with the floor, or may be attached to a rectangular base to afford greater stability. The lower halves of the legs, when removed, enable the easel to function as a table model, and reduce the size of the structure for transport and storage. The structure will support chalk boards, white boards and bulletin boards on both its front and rear faces. The elements may be made so they can be slipped apart in order to be transported or stored in a small package. The lower portion of the legs may be reduced in length for use by children.

2 Claims, 5 Drawing Sheets

PORTABLE EASEL WITH TABLE

BACKGROUND—FIELD OF INVENTION

This invention relates to portable easels, specifically, to easels used to support and display written, graphic, or pictorial materials on easel pads in presentations, training, or teaching.

BACKGROUND—DESCRIPTION OF PRIOR ART

Trainers, teachers, speakers, lecturers, consultants, and others commonly use easels to support easel pads on which to write and draw before and during presentations to enhance the effectiveness of their presentations.

Easels may be three-legged or four-legged devices for supporting easel pads. Some are light and easily portable. Some are heavy, complicated to assemble and use, and are very expensive.

None of the present easels incorporate a table in their structure upon which the presenter may place materials needed in relation to the presentation, though many do include a small tray on the front to hold marking pens.

Many prior art easels have complicated mechanical components which may render the easel useless, or much less useful if a critical part is damaged or lost. A device representing a substantial investment may be rendered useless over the loss of a small, specialized bolt or connector which may be impossible to replace.

Three-legged easels are subject to tipping over if bumped in the direction of the axis between the front leg and the back leg. Most three-legged easels provide little or no support for the top of the easel pad, and allow it to move back and forth as the presenter writes or draws on it, rendering such efforts less controllable and accurate. Some have no back rest to provide a uniform, solid surface to support the easel pad during use. Without a back, the easel can not be used to mount papers, or other materials for static display.

Some easels, especially the four-legged variety, are complicated, heavy, and expensive, and it is not readily apparent how they should be assembled for use.

Some prior art easels utilize a container of durable material in which to transport and protect the easel and easel pad. These devices, while useful, add to the weight of the assembled package and make it heavy and awkward, especially for one of lesser strength and stature, to transport.

U.S. Pat. No. 2,941,774 to McTear, (1960), shows a toy easel designed primarily for supporting a small blackboard on three legs. It is not suitable for supporting an easel pad for use by an adult, nor does it have a cross piece at the top to stabilize an easel pad. It has a retainer to hold a blackboard, but no tray for pens or table for holding resource materials.

U.S. Pat. No. 5,088,678, Bitas, (1992), is a multi-station easel having three or four sides suitable for use by several persons simultaneously. It would not be appropriate for use with easel pads simultaneously because each would interfere with the others during the turning of a page. It has a tray in front of each side, but no table space. It is not suitable for use by a single presenter, and is heavy and difficult to disassemble and transport.

U.S. Pat. No. 3,195,849, Maddox, (1964), is a four-legged folding easel featuring a useful vertically sliding easel board. However, it does not have a tray in the front for retaining marking pens, nor does it have a table behind the easel board for use in placing materials related to a lecture or training. It features many uniquely designed parts, which if damaged or lost, could render the easel much less useful.

U.S. Pat. No. 2,142,317, Jarrett, (1938), is a three-legged wooden easel with pegs in front to support an easel pad, but without a table or tray.

U.S. Pat. No. 518,544, Faint, (1893), is a three-legged wood easel on a sliding frame without a table.

OBJECTS AND ADVANTAGES

Accordingly, besides the objects and advantages of the portable easel with table described above in my patent, several objects and advantages of the present invention are:

(a) to provide a light, easily transportable easel which incorporates a table and tray for marker pens and written materials, such as handouts, for use by the presenter;

(b) to provide an easel which may be used on a table or as a free-standing model;

(c) to provide a support upon which can be mounted a bulletin board, a white dry erase board, a chalk board or a flannel board;

(d) to provide an easel that is durable, not subject to corrosion or complicated assembly techniques, and is easily repairable;

(e) to provide a basic easel design which, with minor modifications, can provide for easel pads with various dimensions; for an easel with easily adjustable height according to the preference and size of the user; for an easel with a wide footprint on the floor for greater stability, as in an easel that is used with children or that is frequently moved; and an easel that can be adapted for use with the same or different types of display surfaces (that is, an easel pad on both sides, or an easel pad on one side and a white dry erase board on the other side) on both sides simultaneously; an easel with a narrow or broad tray for marking materials or paints on one or both sides;

(f) to provide easels that can easily be custom made to the specific requirements of the user;

(g) to provide an easel made of novel, but common materials, specifically polyvinyl chlorine pipe and fittings and hardboard;

(h) to provide an easel which can be used to support various types and sizes of materials attached at the top of the easel board by spring clips;

(i) to provide an easel board which can be used to tape, pin or staple materials to for display purposes;

(j) to provide an easel which can be partially disassembled for transport in a moderate size, or which can be substantially disassembled for transport in a very small package;

(k) to provide a mounting surface suitable for displaying on both the front and the back, two standard easel size sheets of paper.

DRAWING FIGURES

In the drawings, closely related numerals have the same number, but different alphabetic suffixes.

Figure 1:
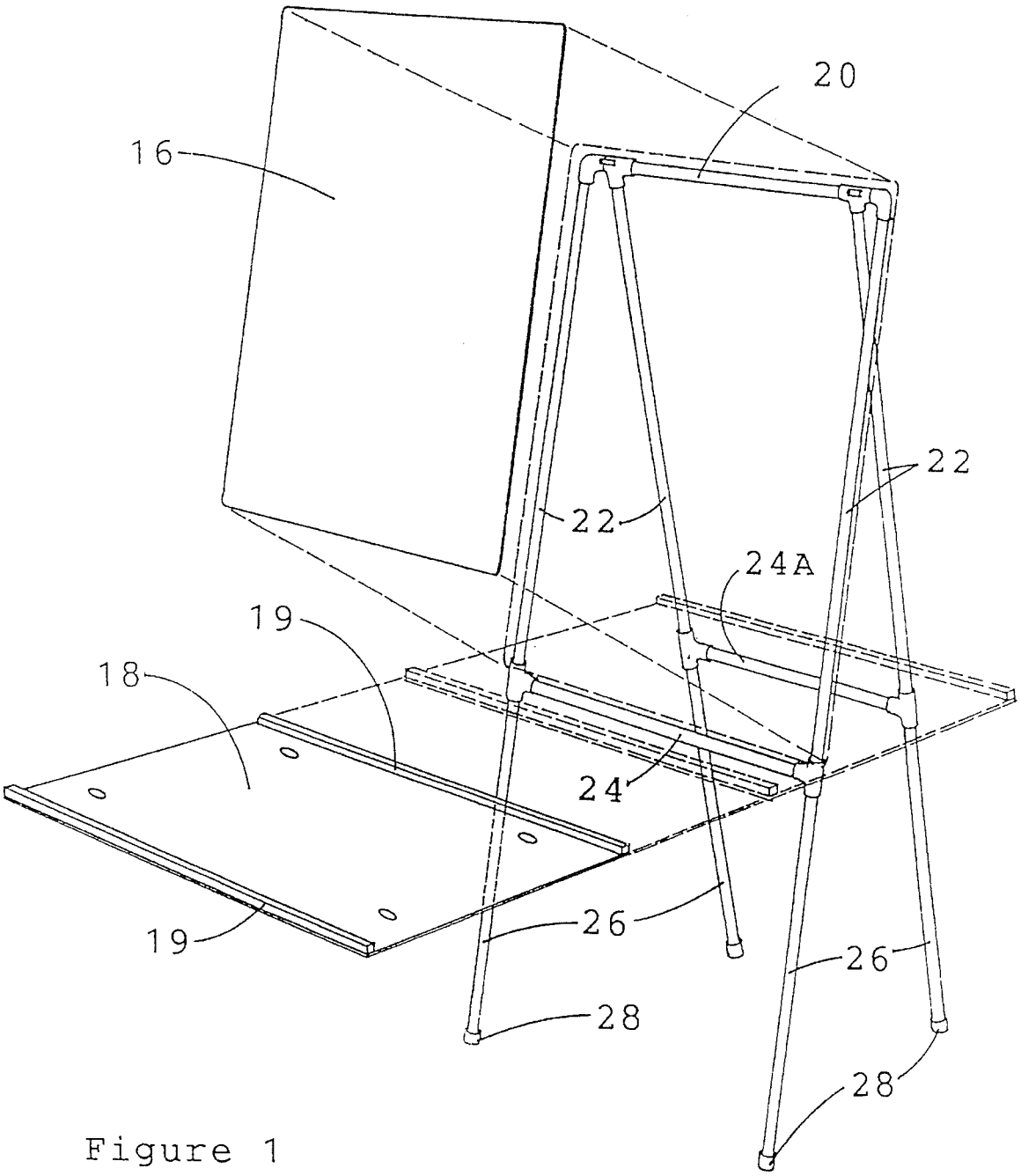
FIG. 1 shows a perspective view of the easel with the tray table and easel board in exploded positions for clarity in viewing the primary structure.

| Reference Numerals in Drawings | |
|---|---|
| 16 easel board | 18 tray table |
| 19 retainer | 20, 20-A top crosspieces |
| 22 upper supports | 24, 24-A lower crosspieces |
| 26, 26-A legs | 28 malleable tips |
| 30 ells | 32 nipples |
| 34, 34-A,B tees | 36 pipe |
| 37 coupling | 38 pegs |
| 40 pins | 42 base, 4-legged |
| 44 base, 3-legged | |

DESCRIPTION—FIGS. 1 THROUGH 7

Figure 2:
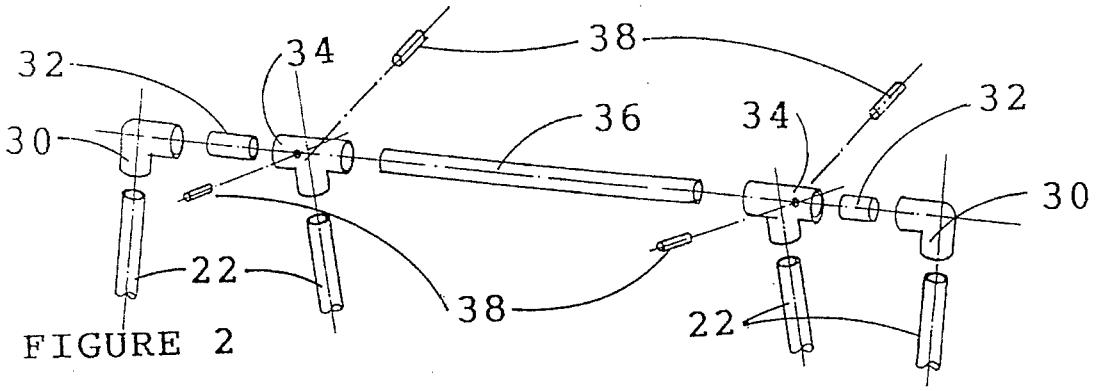
FIG. 2 shows an exploded view of the top support to provide details of its construction.

A typical embodiment of the present invention is illustrated in FIG. 1. The legs 26 fit into the lower crosspieces 24, 24-A, which, in turn, serve as the base upon which the tray table 18 rests. The upper supports 22 fit in holes in the lower crosspieces 24, 24-A, pass through holes in the tray table, 18, and fit into tees (FIG. 2) 34 and ells 30 in the top crosspiece 20 in FIG. 1. The construction of the top crosspiece in this embodiment is detailed in FIG. 2. Holes are drilled in either the tees or ells in the top crosspiece, depending on the spacing of the holes in the particular available easel pad to be used, and pegs 38 are pressed into the holes.

Correspondingly spaced holes in the easel board 16 enable the board to hang from the pegs. The lower edge of the easel board just clears the tray table 18. The front part of the tray table 18 has a retainer 19 on its front edge which prevents objects placed thereon from rolling off, and serves as a tray upon which the user can place pens, brushes, tape, paints, erasers, and the like, as needed. The back part of the tray table 18 serves as a table behind the easel board 16 upon which the user can place written matter, books, tape, marking pen containers, and the like. The table is always present in the preferred embodiments of the invention and is unique and distinctive from other prior art. The legs of this embodiment may be attached either permanently or temporarily into a base 42 as shown in FIG. 5 to enhance stability.

Figure 3:
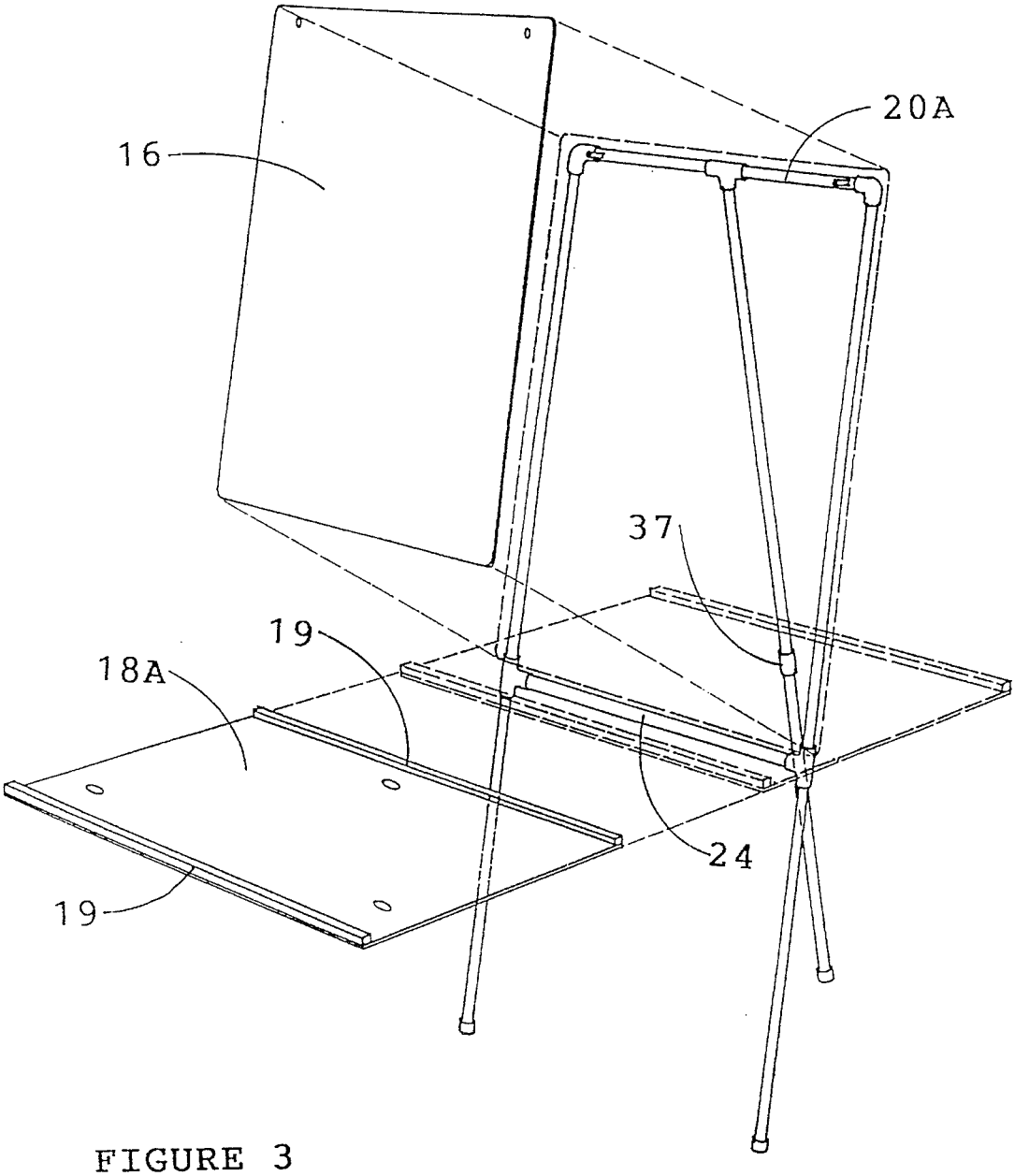
FIG. 3 shows a view of a three-legged embodiment of the easel.
Figure 6:
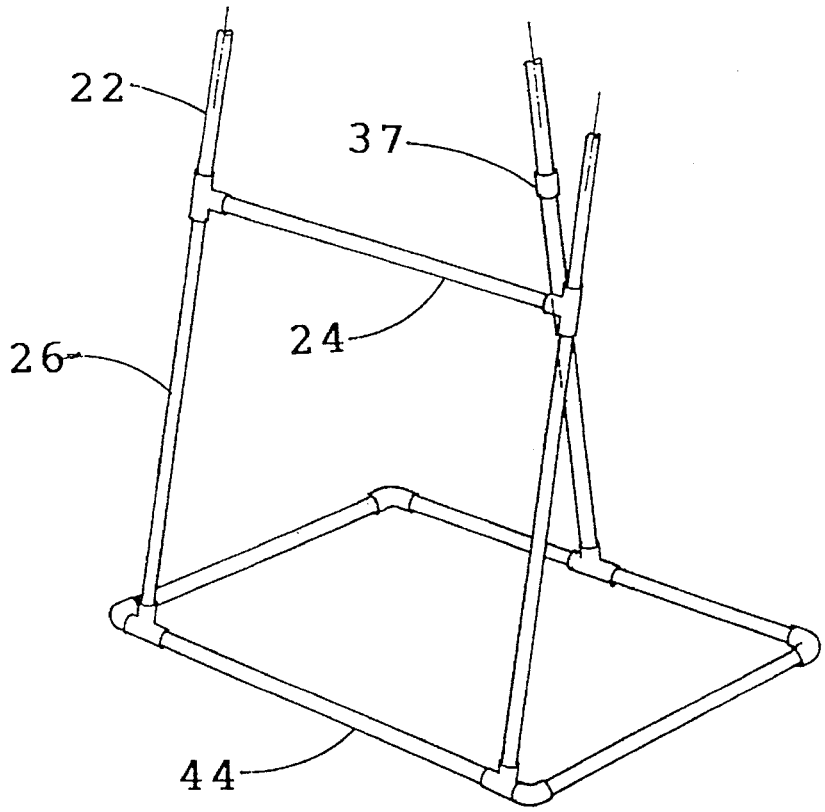

FIG. 3 shows another embodiment of the invention in which there are three legs and upper supports. This embodiment features the same easel board and tray table, and is lighter, and disassembles into a smaller package for storage or transport. It is similar in construction and features to some other prior art, except that it features a table, it can have a base 44 FIG. 6, attached to the lower end of the legs to increase stability, and an easel board may be attached to both the front and back. It can have the legs removed to serve as a table model, as well as the embodiment shown in FIG. 1. It is also suitable for displaying other types of boards, and is well suited for support of a bulletin board where frequent movement is not needed, and for use in places where floor space may be at a minimum. The inherently less stable condition of a three-legged easel may be overcome by the addition of a rectangular base 44 as shown in FIG. 6. The base for either embodiment may be made so that it can be disassembled for transport and storage, or it can be cemented in permanent rectangular form, and either may be permanently or temporarily attached to the leg ends.

Figure 4:
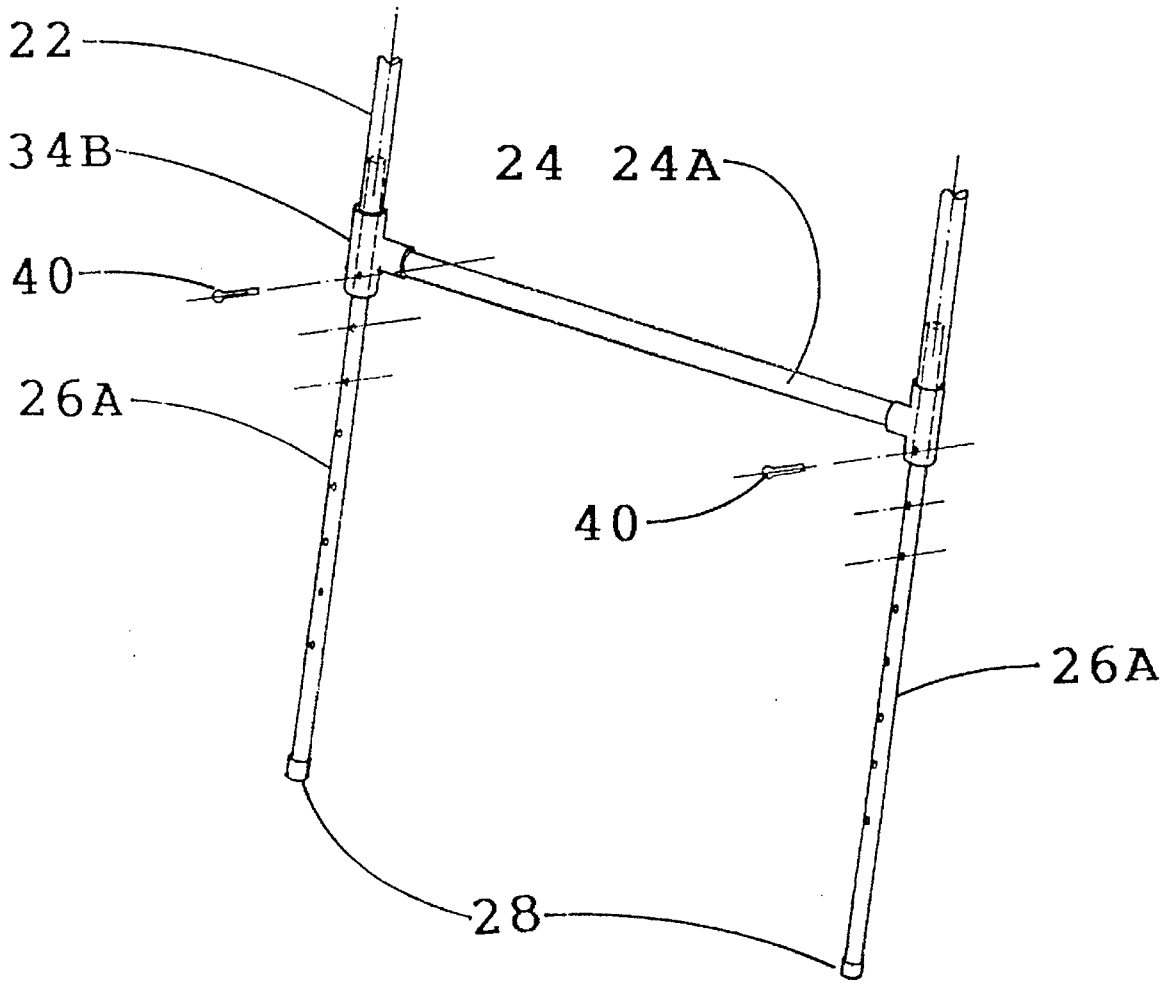
FIG. 4 shows the details of the construction of the legs in a telescoping configuration as a means of adjusting the height and for storage of the legs during transport.

The legs 26-A in FIG. 4 have holes drilled at intervals through which pins 40 may be placed as the legs telescope into the upper supports 22. This feature enables the structure to be adjusted in height to suit children, as well as shorter or seated adults as users. It also enables the legs to be slid up inside the upper supports as another embodiment of a table model, and to encase and retain the legs during transport or storage.

Figure 5:
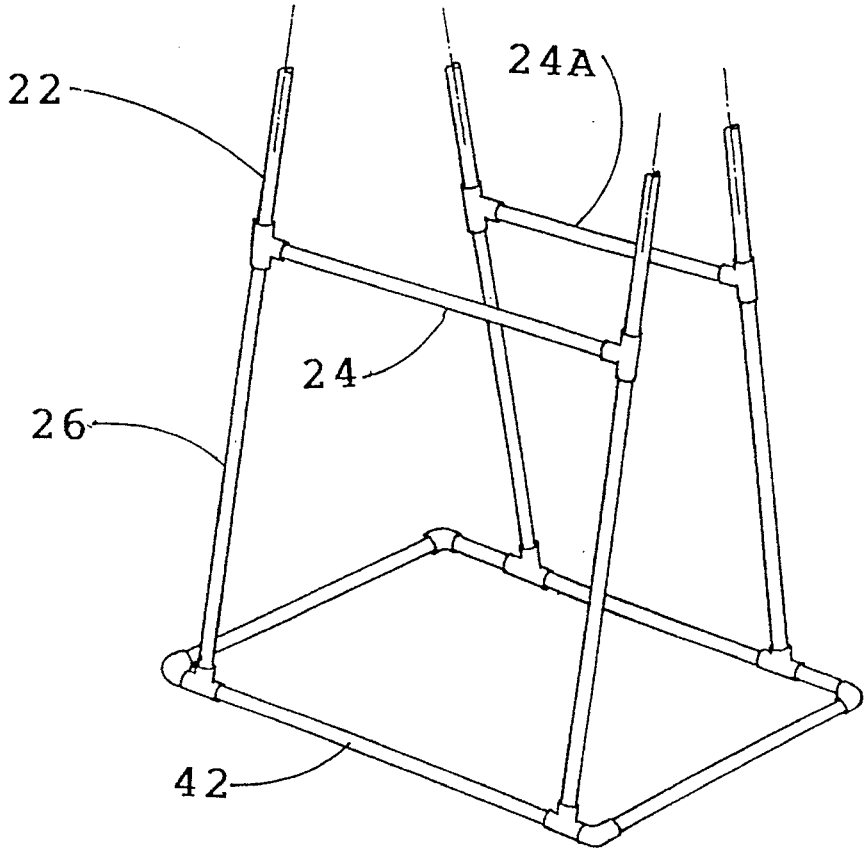
FIGS. 5 and 6 show the legs resting in a base to provide for greater stability for either the three or four-legged embodiment.

The bottom of the legs in either the three-legged or four-legged embodiments may be fixed permanently or temporarily into a rectangular base composed of polyvinyl chlorine pipe and fittings as shown in FIGS. 5 and 6 to increase the footprint of the easel and enhance its stability. The base may be constructed with a footprint that is substantially wider than the legs if much greater stability is required, as in extensive use with young children.

Figure 7:
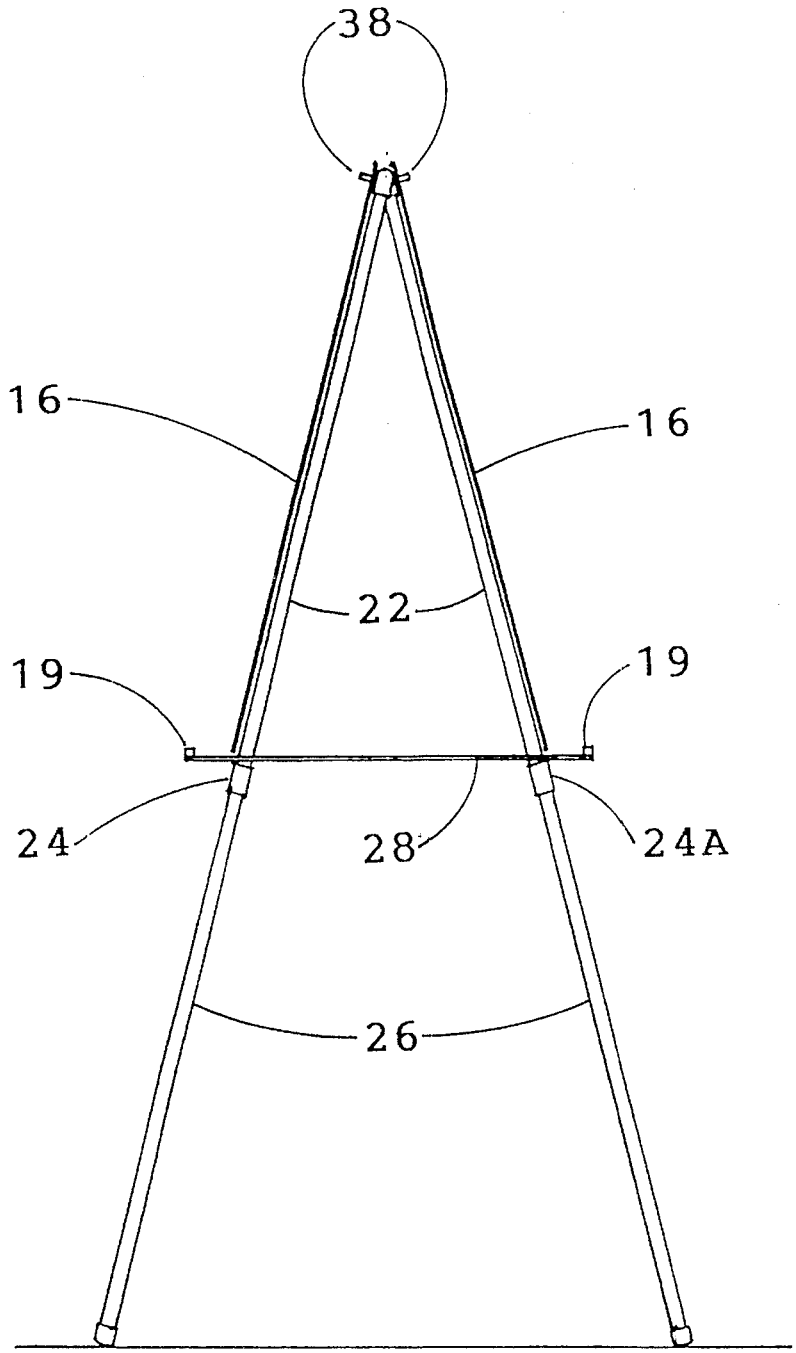
FIG. 7 is an end view of either the three or four-legged embodiment showing the table between the legs, the tray on both the front and back with retainers, an easel board hung from pegs on both front and back sides simultaneously, and the legs resting in the base.

FIG. 7 shows an end view of the easel to clarify an embodiment with tray and easel board on front and back. The table space is still available for use in this configuration.

SUMMARY

This is a portable easel with table and tray with three or four legs suitable for use by adults or children as a free standing or table model. It is capable, with slight modifications, to meet a wide variety of user needs.

DESCRIPTION OF INVENTION

FIG. 1 shows a perspective view of the most common embodiment of my portable easel with tray and table. The main structure consists of two A-frame legs joined at the top by a top crosspiece, and laterally in the middle by two lower crosspieces. A tray table rests on the lower crosspiece fittings and an easel board is hung from pegs protruding from the top crosspiece. The legs are divided into two parts. The top halves of the legs support the upper portion of the structure, including the tray table and top crosspiece, and are permanently cemented in place in the most common embodiment. The lower halves of the legs rest on the floor and support the entire upper structure, and may be removed from the lower crosspieces for storage or transport, and to enable the upper structure to be used as a table model.

A top crosspiece, consisting in this embodiment of polyvinyl chlorine pipe and fittings, is composed of an ell fitting, into which is cemented a short nipple of polyvinyl chlorine pipe, the other end of which is inserted and cemented into a tee fitting, into which is inserted in the other end of its through opening a polyvinyl chlorine pipe, the other end of which is inserted and cemented into a tee fitting, which has inserted and cemented into its other through opening a short polyvinyl chlorine nipple, which is inserted and cemented into an ell fitting. Holes may be drilled through the front and rear portion of the top crosspiece near each end and short pegs, in this embodiment composed of wooden doweling, are press fit into each hole. The pegs and holes are spaced so as to match the holes in available commercial easel pads, and enable pads to be hung from one or both sides simultaneously.

A set of supports composed of polyvinyl chlorine pipe are inserted and cemented into the downward oriented openings in the top crosspiece tee and ell fittings. The downward openings of the ell fittings are oriented slightly forward of vertical and the downward openings of the tee fittings are oriented slightly backward from vertical. These supports in the openings are splayed in such a manner that their lower ends are inserted through holes in a tray table composed of thin, flat, rigid material, in this embodiment, hardboard. The tray table has a retainer, in this embodiment composed of a length of wooden quarter round, attached to the upper front edge, or front and rear edges both. The tray table rests horizontally on the upper portion of an appropriate number of tee fittings, or a combination of tee fittings and a coupler in the three-legged embodiment. A length of polyvinyl chlorine pipe is inserted and cemented into each of the horizontal openings of the tee fittings in the lower crosspieces.

A set of legs composed of polyvinyl chlorine pipe are inserted, but not cemented, into the downward facing through openings in the tees in the lower crosspieces. Each lower leg end has pressed over it a rubber furniture leg tip, or similar malleable material, to provide a grip on the floor.

An easel board composed of thin, flat, rigid material, in this embodiment, hardboard, hangs, in an almost vertical manner from holes drilled into it near its top surface, by the pegs in the top crosspiece. Pegs can be inserted into holes drilled in the rear of the top crosspiece so that an easel board and easel pad, or just an easel pad alone may be hung from either the front or back or both sides of the easel.

OPERATION OF INVENTION

The easel claimed in this invention is designed for use by adults or children for drawing, writing and display of material for teaching, presentations, and recreation.

The top crosspiece joins the legs together at the top by attaching the upper portions thereof, called upper supports, by means of tee and ell fittings and a polyvinyl chlorine pipe cross member. The legs are thus held together at the top in an appropriately splayed position. The top crosspiece has holes in its front face, or both front and rear faces. The holes do not go all the way through the crosspiece, but rather go only through the front surface, so that the peg can rest against the inside of the back surface for increased rigidity. The outsides of the pegs are tilted slightly upward to serve as supports for the easel board and easel pad. The slight upward orientation of the pegs prevents the easel board and easel pads from easily sliding off, but enable the user to flip a page of the easel pad over the top to the back to expose the next sheet, and to easily remove the pad from the easel. The pegs can be spaced in width and made in diameters suitable to accommodate the holes in any commercially available easel pads. Multiple sets of holes can be drilled into the top crosspiece to enable the use of a variety of easel pads with different spacing of their holes. The easel pad is also held in position while the user tears off a sheet. The elements of the top crosspiece are cemented together for rigidity, but the upper supports may be pressed by hand into the top crosspiece fittings and into the lower crosspieces to enable them to be disassembled in the event that the smallest possible transport and storage assembly is desired. It is also possible to remove the pegs from their holes in the top crosspiece since they can be either press fit or cemented into place. The easel board and easel pads would still rest on the tray and lean against the upper supports and top crosspiece, but they could be removed and the remaining structure, with or without the easel board, would support chalk boards, white boards, bulletin boards, flannel boards, and the like.

The tray table serves three functions: (1) The front portion extends forward ahead of the easel board and has a retainer on its upper front surface which enables it to be used as a tray upon which the user can place marker pens, crayons, pens, pencils, brushes, and the like. The portion of the tray which extends beyond the rear legs can also have a retainer to serve as a marker receptacle. The upper support portions of the legs pass through holes in the tray table. In the most common embodiment, the front legs and upper supports are on the outside ends of the top crosspiece, with the back legs and upper supports immediately adjacent to them inwardly on the top crosspiece. (2) The upper support portion of the legs pass through holes in the table which hold the legs in their splayed position, assisted in this function by the rigidity of the fittings in the top crosspiece. (3) The rear portion of the tray table extends behind the easel board and serves as a surface upon which the user can place papers, books and other materials appropriate for use with presentations, teaching, and the like. This rear portion may also have a retainer placed on it to serve as a tray for an easel board hung from the back face of the easel.

In the most common embodiment, the top crosspiece, upper supports, tray table, and lower crosspieces are attached permanently together. In this configuration, the easel can be easily transported with one hand, and an easel pad can be left on the pegs to facilitate its transportation as well.

When the legs are not attached to the lower crosspieces, the remaining upper portion of the structure just described is triangular as seen from the side and rectangular as seen from the front. This assembly can be stored, and can be easily transported with one hand by the user, and can be placed on its side, back, or lower end for transport together with the easel pad. The legs can be placed on the tray table between the upper support structures for storage or transport. This assembly can also be placed on a table or desk for use as a table model easel with all the same functions of the free standing easel. The user can place this assembly on the end of a table facing a group and use the remaining portion of the table to support a wide variety of materials for use in presentations and teaching.

The lower portion of the legs, called in this manifestation simply, legs, are press fitted, or may telescope into the lower crosspieces to support the upper structure and thus constitute the free standing easel. The legs may also be removed from the lower crosspieces for use as a table model. In either case, the legs have, in this embodiment, rubber, or similar, tips on their lower ends to enhance the structure's stability. The legs consist of polyvinyl chlorine pipe and could easily be cut at a point in their length to make the entire structure low enough for use by a child. With the addition of a coupling fitting, the legs could then be fixed back together at their previous length for use by an adult. In another embodiment, the legs can terminate at the floor, not with rubber tips, but could be press fit or cemented into a rectangular assembly of polyvinyl chlorine pipe to extend the footprint of the easel into as large a size as necessary to assure stability for young users, and to assure added rigidity in the event the entire structure might need to be moved frequently from place to place within a building as a free standing unit.

CONCLUSIONS, RAMIFICATIONS, AND SCOPE OF INVENTION

Thus the reader will see that the portable easel with tray and table invention provides a highly reliable, lightweight, simple, yet economical and effective device suitable for use by teachers, consultants, trainers, and students for a wide variety of training, teaching, presentations, and communicating purposes.

While my above description contains many specifications, these should not be construed as limitations on the scope of the invention, but rather as an exemplification of one preferred embodiment thereof. Many other variations are possible:

The easel can be used without the easel board. The cardboard backing of available easel pads provides sufficient rigidity for many uses.

The upper form supports may be press fit, but not cemented into the top crosspiece and lower crosspieces enabling the entire structure, not including the easel board, to be fit into a small package for easy transport and storage.

The legs may be cemented into place for greater permanence where the easel is not to be moved from place to place.

The entire structure can be painted to suit the user.

The three-legged embodiment is lighter, easier to assemble and transport, and retains all the essential features of the four-legged embodiment.

The legs can be made as long or as short as the user desires, and can be reduced in length for use by a child, then can be restored with the aid of a coupling, to their previous length for use by an adult.

The legs can be made to telescope into the upper supports and can be adjustable, with pins, to a variety of lengths.

A variety of materials can be used in the construction of the easel with all essential functions remaining.

The pegs in the top crosspiece can be left in place or removed and the remaining structure, with or without the easel board, can be used to support a wide variety of boards for other purposes, such as bulletin boards, white dry erase boards, chalk boards, and flannel boards.

Two pages of easel paper can be taped to both the front and back sides each simultaneously to effect a four page sandwich board for display purposes.

Easel pads can be placed on the front and back sides simultaneously for easy use in both directions. The back can be used for the temporary placement of a second easel pad for use when the front pad is depleted.

The top structure, without the legs, can be used on a table, affording easy movement from table to table, or for close inspection of displayed material by a group of persons seated around a table.

The legs of either the three-legged or four-legged embodiments may be fitted into a rectangular base to increase the footprint and the stability of the easel.

The tray may be made wider to accommodate jars or cans of paint or pigments if so desired by the user.

I claim:

1. A portable easel comprising:

a horizontal top crosspiece;

two rearwardly inclined front legs, each connected at an upper end thereof to opposite ends of said top crosspiece;

at least one forwardly inclined rear leg connected at an upper end thereof to said top crosspiece between said two front legs;

a horizontal lower front crosspiece connected at each end to said two front legs;

two pegs extending generally horizontally from the front of said top crosspiece;

an easel board with holes near an upper end thereof for placement upon said pegs, said board being adapted to hang from said pegs with the back of said board resting against said front legs; and a horizontal tray table with holes therethrough whereby said table rests upon said lower front crosspiece, said front and rear legs extending through said tray table holes for holding said tray table in place.

2. The easel of claim 1 wherein:

said at least one rear leg comprises two rear legs, and said tray table further rests upon a lower rear horizontal crosspiece connected at each end to said two rear legs.

* * * * *